US009634401B2

(12) United States Patent
Belmkaddem et al.

(10) Patent No.: US 9,634,401 B2
(45) Date of Patent: Apr. 25, 2017

(54) ANTENNA ARRAY

(71) Applicant: Commissariat à l'énergie atomique et aux énergies alternatives, Paris (FR)

(72) Inventors: Kawtar Belmkaddem, Grenoble (FR); Lionel Rudant, Grenoble (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 111 days.

(21) Appl. No.: 14/464,022

(22) Filed: Aug. 20, 2014

(65) Prior Publication Data

US 2015/0054700 A1 Feb. 26, 2015

(30) Foreign Application Priority Data

Aug. 20, 2013 (FR) ..... 13 58090

(51) Int. Cl.
*H01Q 9/00* (2006.01)
*H01Q 21/00* (2006.01)
*H01Q 1/48* (2006.01)

(52) U.S. Cl.
CPC ..... *H01Q 21/00* (2013.01); *H01Q 1/48* (2013.01)

(58) Field of Classification Search
CPC ..... H01Q 21/12; H01Q 21/14; H01Q 19/30; H01Q 9/42
USPC ..... 343/750, 745, 815, 813, 818
See application file for complete search history.

(56) References Cited

U.S. PATENT DOCUMENTS 6,121,940 A * 9/2000 Skahill ..... H01Q 9/00 343/701
7,898,493 B1 3/2011 Rojas et al.
2006/0232492 A1 10/2006 Sawatani
2007/0188392 A1* 8/2007 Kanazawa ..... H01Q 19/32 343/702
2010/0231453 A1* 9/2010 Shinkai ..... H01Q 1/2291 342/368
2011/0309994 A1 12/2011 Kato et al.
2013/0293435 A1* 11/2013 White ..... H01Q 1/523 343/810

OTHER PUBLICATIONS

Warren L. Stutzman and Gary A Thiele, "Antenna Theory and Design", Jan. 1, 1998, John Wiley & Sons, USA, XP002727044, p. 25-40.

* cited by examiner

*Primary Examiner* — Graham Smith
*Assistant Examiner* — Collin Dawkins
(74) *Attorney, Agent, or Firm* — Knobbe, Martens, Olson & Bear LLP

(57) ABSTRACT

This antenna array includes at least one primary antenna, at least one secondary antenna and at least one load coupled to a secondary antenna. The load includes two separate components, a first component being a resistor and a second component being selected from an inductor or a capacitor. The antenna array can include one or more of the following characteristic features, taken into consideration individually or in accordance with any technically possible combinations: the first component has negative resistance; the second component has negative inductance or a negative capacitance; at least one load has an adjustable impedance. The antenna array may be used in a system, such as a vehicle, a terminal, a mobile telephone, a wireless network access point, a base station, or a radio frequency excitation probe.

7 Claims, 2 Drawing Sheets

ANTENNA ARRAY

FIELD OF THE INVENTION

The present invention relates to a method for determining an antenna array. The present invention also relates to an antenna array.

BACKGROUND OF THE INVENTION

The invention is applicable to the field of antenna arrays. For a number of applications, a directional radiation pattern is desirable. By way of an example, a focused radiation in a preferred direction is required for detection and communication with a target. Avoiding electromagnetic pollution outside of the useful zones is another example of an application involving a relatively directional radiation pattern.

In order to increase the directivity of an antenna array, it is a known technique from the state of the art to use reflectors such as parabolic reflectors, to network antennas or to combine coupled antennas as in the case of antennas like the Yagi-Uda.

However, these solutions greatly increase the size of the antenna array. Indeed, the directivity of a reflector antenna is typically estimated by $$D = \frac{4\pi}{\lambda^2} A$$

where A is the projected surface area visible along the main direction of radiation. In particular, this means that for a reflector disk of radius R, $$D = \frac{4\pi^2 R^2}{\lambda^2}.$$

It is also a known technique to jointly excite a mode of radiation such as the transverse electric (TE) type and a magnetic mode (TM) within a same given antenna array network. An antenna array structure that supports such an operation is called a Huygens source. For example, in the document FR-A-2949611, the teaching provides for a structure based on a resonator constituted of a ring shaped helical conductor that provides a Huygens source with a reduced antenna size.

However, the level of maximum directivity achievable with this type of antenna array structure is limited by the directivity of the ideal Huygens source, which is 4.7 dBi. The unit dBi signifies "decibel isotropic". In a general sense, the directivity of an antenna is normally expressed in dBi, by taking as a reference an isotropic antenna, that is to say, a fictitious antenna of the same total radiated power that radiates uniformly in all directions with a radiation of 0 dBi.

SUMMARY OF THE INVENTION

There is therefore a need for an antenna array having enhanced directivity with reduced compactness.

According to the invention, this objective is achieved by an antenna array comprising at least one primary antenna, at least one secondary antenna and at least one load coupled to a secondary antenna. The load comprises two separate components, a first component being a resistor and a second component being selected from an inductor or a capacitor.

According to particular embodiments, the antenna array includes one or more of the following characteristic features, taken into consideration individually or in accordance with any technically possible combinations:

- the first component has negative resistance;
- the second component has negative inductance or a negative capacitance;
- at least one load has an adjustable impedance.

The invention also relates to a use of an antenna array as previously described here above in a system, the system being selected from the group consisting of a vehicle, a terminal, a mobile telephone, a wireless network access point, a base station, or a radio frequency excitation probe.

BRIEF DESCRIPTION OF THE DRAWINGS

Other characteristic features and advantages of the invention will become apparent upon reviewing the description that follows of embodiments of the invention given only by way of example and with reference made to the drawings which are as follows.

DETAILED DESCRIPTION

Figure 1:
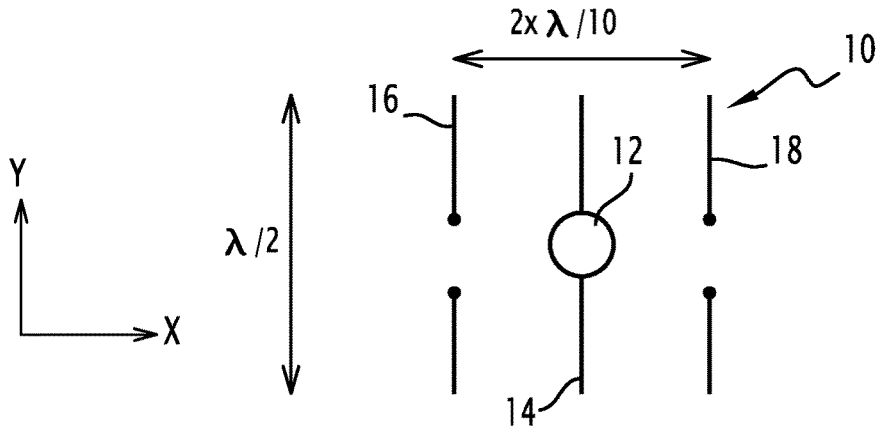
FIG. 1 is a diagrammatic representation of a generic antenna array according to an embodiment.
Figure 2:
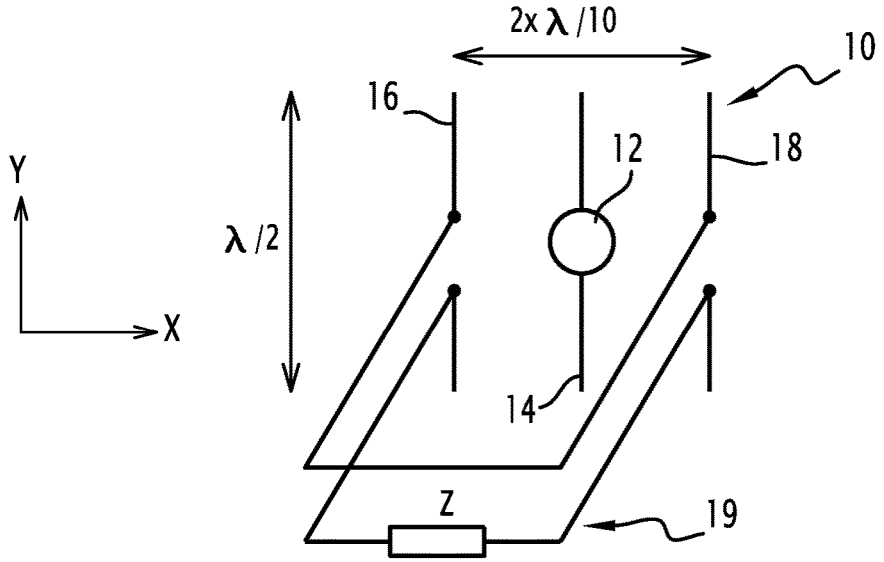
FIG. 2 is a diagrammatic representation of an antenna array according to a first embodiment.
Figure 3:
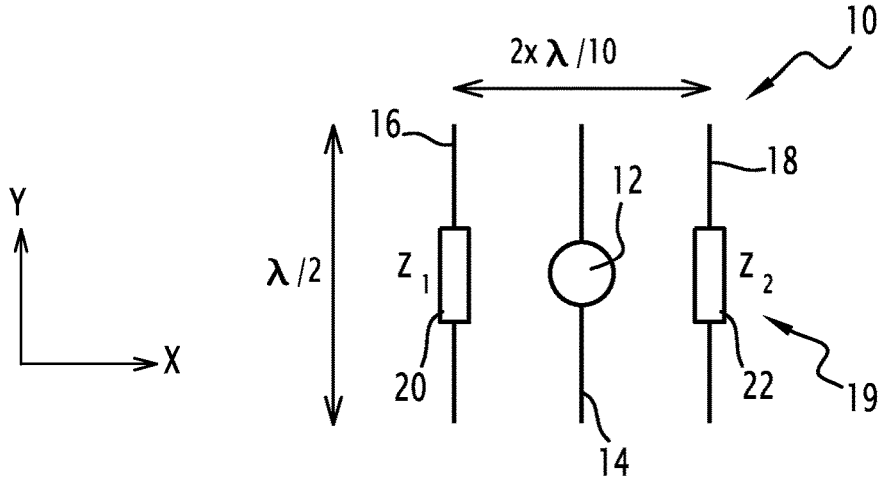
FIG. 3 is a diagrammatic representation of an antenna array according to a second embodiment.

An antenna array 10 has been provided as shown in a generic fashion in FIG. 1 and in the two embodiments in FIGS. 2 and 3. An antenna array generally comprises at least one primary antenna and one secondary antenna. Each of the antennas belonging to the antenna array comprises one or more radiating parts. The radiating parts of each separate antenna are physically separated. The term "physically separated", is understood to mean that there is no physical contact between two radiating parts belonging to two distinct and separate antennas.

For the rest of the description, two axes X and Y contained in the FIGS. 1 to 3 have been defined. The axis X is perpendicular to the axis Y. A direction parallel to the axis X is referred to as a longitudinal direction and a direction parallel to the axis Y is referred to as a transverse direction.

The antenna array 10 comprises a source 12, a first antenna 14, a second antenna 16, a third antenna 18 and a circuit 19 (not shown in FIG. 1).

The first antenna 14 is an antenna 12 associated with the source. With the source 12 outputting a signal that is useful for the application considered for the array 10, the first antenna 14 is considered as a primary antenna. Thus, the first antenna 14 is referred to as the primary antenna in the following sections.

The second antenna 16 is an antenna coupled to a passive or active load. The second antenna 16 is not directly coupled to a source supplying a useful signal. The second antenna 16 is, in this sense, a secondary antenna while the first antenna 14 is a primary antenna. The same observation applies for the third antenna 18 Thus, the second antenna 16 and the third antenna 18 are referred to as secondary antennas in the following sections of the description.

The number of antennas in the antenna array 10 is given by way of an example, with any type of antenna array 10 comprising at least one antenna that can be connected to a circuit 19 being able to be considered.

In particular, the antenna array 10 includes, in certain embodiments, a plurality of primary antennas.

By way of a variant, the antenna array 10 includes a large number, for example around ten or one hundred, secondary antennas.

The antenna array 10 is adapted to generate an electromagnetic wave denoted as Ototal. The antenna array 10 is thus capable of operating for at least one wavelength denoted as λ in the following sections of the description. The wavelength λ is comprised between a few hundredths of millimeters and a few tens of meters. This corresponds, in terms of frequencies, to the frequency range between the high frequency band (often referred to by the acronym HF) and frequencies of the order of a few terahertz.

According to the application considered (cellular telephony, home automation, etc) the antenna array 10 is capable of operating over more limited frequency ranges.

Advantageously, the antenna array 10 is capable of operating for a band of frequencies comprised between 30 MHz and 90 GHz. This makes the antenna array 10 considered particularly suitable for radio communications.

The circuit 19 is a circuit having parameters that influence the electromagnetic wave generated by the antenna array 10.

The circuit 19 is either a coupling circuit based on waveguides associated with a load Z as illustrated in the FIG. 2, or at least a load as shown in FIG. 3, or a circuit that is a hybrid between the coupling circuit shown in FIG. 2 and the load shown in FIG. 3.

In FIG. 2, the circuit 19 is a waveguide connecting the second antenna 16 to the third antenna 18 by means of a load Z (which may not be present). This simple arrangement may be made as complex as desired according to the embodiments contemplated.

In the case of the circuit 19 shown in FIG. 2, the parameters influencing the electromagnetic wave Ototal generated by the antenna array 10 are the parameters that characterise the shape of the coupling circuit. For example, the impedance of the load Z, the specific impedance of the wave guide used, the length of the waveguide are examples of parameters that characterise the coupling circuit. In the case of FIG. 3, the circuit 19 includes two loads 20, 21, the first load 20 being connected to the second antenna 16 and the second load 21 being connected to the third antenna 18.

In this example, the parameters influencing the electromagnetic wave Ototal generated by the antenna array 10 are the respective values of the impedance of each of the loads 20, 22.

Preferably, at least one load from the first load 20 and the second load 22 includes two distinctly separate components, a first component being a resistor and the other component being selected from an inductor or a capacitor.

The term "separate component" is understood to imply that each component has parasitic impedances that are negligible relative to its primary impedance. Thus, a resistor has a resistance value that is far higher than the parasitic resistance of an inductor or a capacitor. In a similar fashion, a capacitor has a capacitance value that is far higher than the parasitic capacitance of an inductor or a resistor and an inductor has an inductance value that is far higher than the parasitic inductance of a resistor or a capacitor.

In the case of FIG. 3, by way of example, it is the two loads 20 and 22 which comprise of two distinctly separate components.

Preferably, the impedance of each load 20, 22 presents:

a real part that is strictly less than 0, or a non-zero imaginary part and a non-zero real part.

According to another embodiment, at least one load 20, 22 has an adjustable impedance. This makes the antenna array 10 more flexible.

By way of a variant, at least one load 20, 22 is an active component.

It is proposed to determine the antenna array 10 illustrated in FIG. 2 or FIG. 3 by means of a method of determination.

The method for determining includes a step of selecting a criterion to be verified for the wave Ototal generated by the antenna array 10.

In a general sense, the criterion is either a performance criterion or a criterion of compliance with a mask.

The directivity of the antenna array 10 in a given direction and the front to back ratio of the antenna array 10 are two examples of performance criteria.

Whether the radiation pattern of the array 10 is substantially identical to a radiation pattern obtained based on a specific mask, or whether the radiation pattern of the array 10 in a disturbed environment is identical to a desired radiation pattern, are two examples of the criterion of testing for compliance with a mask.

The method relies on a subsequent step of decomposition of a wave in a basis. The method also includes a step of determining the decomposition coefficients desired, for example by decomposing a wave that satisfies the criterion chosen. Preferably, the basis set used in the decomposition step is the spherical mode basis. This basis provides the ability to simplify the required calculations to be performed while maintaining a good level of precision. Indeed, selecting this basis does not involve use of an approximation.

Advantageously, the decomposition step is performed by making use of a matrix calculation in order to decrease the time for implementation of this step.

The method then includes a step of calculating the parameters influencing the electromagnetic wave Ototal generated by the antenna array 10, for example the parameters for each circuit 20, 22 of the antenna array 10 so as to ensure that the difference between the coefficients of decomposition on the basis of the wave generated by the antenna array 10 and the decomposition coefficients desired is minimum.

Applied to the case shown in the FIG. 2, this step of calculating makes it possible to obtain the parameters characterising the form of the coupling circuit forming the circuit 19.

Applied to the case shown in the FIG. 3, this step of calculating makes it possible to obtain the values of the impedances Z1 and Z2 of the two loads 20, 22.

Advantageously, the step of calculating is performed by making use of matrix calculation, which simplifies the implementation of this step.

Preferably, the calculation step comprises a sub-step of calculating an excitation vector Λ of the antenna array 10 to be used to obtain the desired decomposition coefficients and a sub step of determining the parameters influencing the electromagnetic wave Ototal generated by the antenna array 10 for each load 20, 22 of the antenna array 10 based on the excitation vector Λ calculated.

The method thus provides the ability to optimise the antenna array 10 in order for the antenna array 10 to respond to a desired criterion. This optimisation is an optimisation that makes it possible to find the best value when it exists and to do this in a highly accurate manner without having to perform an iterative optimisation.

Thus, an antenna array 10 is obtained that presents enhanced properties.

The antenna array 10 thus determined is found to have application in a number of systems. By way of example, one may cite the following: a vehicle, a terminal, a mobile phone, a wireless network access point, a base station, a radio frequency excitation probe, etc.

In the following section, a detailed description is provided, by way of example, of the antenna array 10 shown in FIG. 3 as well as the method of determination applied to the antenna array 10 shown in FIG. 3, it being understood that the extension of the application of the method for determining the antenna array 10 described in FIG. 2 is available to the person skilled in the art by making use of the teachings presented here below.

FIG. 3 illustrates a schematic representation of an antenna array 10 having a source 12, a first antenna 14, a second antenna 16, a third antenna 18, a circuit 19 comprising of a first load 20 and a second load 22.

The source 12 is, for example, a radio frequency wave generator. The source 12 is capable of providing radio frequency excitation waves for the primary antenna 14 at the wavelength λ. The source 12 is connected to the first antenna 14. The source 12 may have an internal impedance of 50 Ohms.

According to the example shown in FIG. 3, the first antenna 14 is presented in the form of a conductive wire extending along a longitudinal direction. Along this longitudinal direction, the first antenna 14 is of a size equal to λ/2.

According to the example shown in FIG. 3, the second antenna 16 is also present in the form of a conductive wire extending along a longitudinal direction. Along this longitudinal direction, the second antenna 16 is of a size equal to λ/2. The second antenna 16 is disposed parallel to the first antenna 14 at a distance of λ/10 from the first antenna 14 along a transverse direction.

According to the example shown in FIG. 3, the third antenna 18 is also present in the form of a conductive wire extending along a longitudinal direction. Along the longitudinal direction, the third antenna 18 is of a size equal to λ/2. The third antenna 18 is disposed parallel to the first antenna 14 at a distance of λ/10 from the first antenna 14 along a transverse direction. The third antenna 18 is also disposed parallel to the second antenna 16 at a distance of λ/5 from the second antenna 16 along the transverse direction. Expressed in other words, the first antenna 14 is disposed in the middle of the second antenna 16 and the third antenna 18. This arrangement is described only by way of an example, it being understood that consideration of any other arrangement is possible.

The first load 20 is connected to the second antenna 16.

The first load 20 includes at least two distinctly separate components. For example, the first load 20 is the combination of a capacitor and a resistor. By way of a variant, the first load 20 is the combination of an inductor and a resistor.

The Impedance of the first load 20 is denoted as Z1.

Advantageously, the impedance Z1 of the first load 20 has a real part that is strictly less than 0, or a non zero imaginary part and a non zero real part. In effect, the implementation of these types of loads makes it possible to obtain a decomposition of the wave closest to the desired coefficients, as compared to the conventional solutions which exclude the use of resistors coupled with reactors in order to limit the losses in the antenna array 10.

This implies that the first load 20 is not a pure resistor or a pure reactor.

Thus, according to one embodiment, the impedance Z1 of the first load 20 is equivalent to the connection in series of a resistor and a coil, the inductance of the coil being greater than 1 nH.

According to another embodiment, the impedance Z1 of the first load 20 is equivalent to the connection in series of a resistor and a capacitor, the capacitance of the capacitor being greater than 0.1 pF. According to yet another embodiment, the impedance Z1 of the first load 20 is equivalent to the connection in series of a resistor and a capacitor or a coil, with the resistance being greater than 0.1 ohms.

According to a variant, the impedance Z1 has a negative real part. The creation of a negative resistance is brought about in a manner known in the state of the art through the introduction of an active device, for example an operational amplifier to produce a negative resistance.

According to another variant, the impedance Z1 has a negative imaginary part. The creation of a negative capacitance or a negative inductance is done by making use of a type of circuit arrangement like the Negative Impedance Converter (NIC).

Thus, according to these two variants that may be combined, the first load 20 includes one or more active components.

Another advantage of the active components is that they provide the ability to easily produce components that have the opposite impedance that would be difficult to achieve in practice. Typically, a large inductor of compact dimensions is difficult to achieve by making use of an inductor, but may be obtained with a circuit arrangement carrying a negative capacitance. In similar fashion, a small capacitance is more easily obtained by using a circuit arrangement carrying a negative inductance.

Preferably, the impedance Z1 corresponds to the impedance of a mixed load that is both resistive and reactive. In other words, the impedance Z1 has a non zero real part and a non zero imaginary part.

The second load 22 is connected to the third antenna 18.

The second load 22 has an impedance Z2. The same remarks as those made earlier for the impedance Z1 of the first load 20 are applicable to the impedance Z2 of the second load 22.

The operation of the antenna array 10 shall now be described.

During operation, the source 12 emits a radio frequency wave capable of exciting the first antenna 14.

The first antenna 14 then emits a first radio frequency wave O1 under the effect of the excitation due to the source 12. This radio frequency wave O1 corresponds to a first electric field denoted as E1.

The electric field E1 then excites the secondary antennas 16 and 18.

In response, the second antenna 16 emits a second radio frequency wave O2 under the effect of the excitation due to the electric field E1. This second radio frequency wave O2 corresponds to a second electric field denoted as E2. The second electric field E2 depends particularly on the value of the impedance Z1 of the first load 20.

Similarly, in response, the third antenna 16 emits a third radio frequency wave O3 under the effect of the excitation due to the electric field E1. This third radio frequency wave O3 corresponds to a third electric field denoted as E3. The third electric field E3 depends particularly on the value of the impedance Z3 of the second load 22.

Thus, when the source 12 emits a radio frequency wave, the antenna array 10 emits a radio frequency wave Ototal which corresponds to the superposition of the first wave generated by the first antenna 14 and of the second and third waves generated by the second and third antennas 16 and 18. In terms of electric field, by denoting as Etotal the electric field of the antenna array 10 associated with the radio frequency wave Ototal, such a superposition implies that the electric field of the antenna array 10 is the sum of the three electric fields of the three antennas 14, 16, and 18 of the array network. This is written according to the following mathematical relationship:

$$E\text{total}(Z1,Z2)=E1+E2(Z1)+E3(Z2)$$

In the preceding relationship, it was demonstrated that the electric field of the antenna array 10 is a function of the value of the impedances Z1 and Z2 of the first and second loads 20, 22 via the second field E2 and the third field E3.

This dependence confers on the antenna array 10 the possibility of adjustment of the electric field generated by the antenna array 10 independent of the specific structure of the antenna array 10 (number of antennas 14, 16, 18, form of the antennas 14, 16, 18 and relative positions of the antennas 14, 16, 18). This is particularly advantageous insofar as modification of the structure of the antenna array 10 results in modifications to the electric field produced by the antenna array 10 that are often difficult to predict.

By modification of the values of the impedances Z1 and Z2 of loads 20 and 22, it is possible to modify the radiation pattern obtained for the antenna array 10. In particular, according to one preferred embodiment, the radiation pattern is made directive in a preferred direction by imposing the values of impedances Z1 and Z2. This property is obtained while maintaining a compact antenna array 10. In fact, the antenna array 10 is of a dimension λ/2 along a longitudinal direction and of a dimension λ/5 along a transverse direction.

The property of the antenna array 10 according to which the total radiation produced is controllable by the choice of impedances Z1, Z2 of the loads 20, 22 may in particular be exploited in the context of a method for determining the antenna array 10 so as to ensure that the total radio frequency wave Ototal generated by the antenna array 10 complies with a desired criterion. An example of implementation of such a method is described in the following sections.

For a clearer understanding, the method is firstly presented in a general case of any arbitrary antenna array 10 comprising of any number of antennas and then applied to the particular case of the antenna array 10 shown in FIG. 3.

The array method for determining firstly includes a step of selecting a criterion to be verified for the total radio frequency wave Ototal generated by the antenna array 10.

By way of an example, for the remainder of the description, it is assumed that the criterion chosen is better directivity of the antenna array 10 in a direction of elevation angle $\theta_0$ and azimuth angle $\phi_0$. Other criteria may be considered like optimisation with respect to a criterion of performance of the antenna like the reduction of a cross-polarisation level (that is to say perpendicular to the main polarisation of the wave considered) in a given direction or even the maximisation of the front to back ratio etc. The criterion may also be in compliance with a given type of radiation such as a dipole type radiation or any other radiation types specified by a radiation mask.

The method is based on the decomposition of a wave in a basis. The method also includes a step of determining the decomposition coefficients to be used for achieving the criterion chosen for example by decomposing a wave satisfying the criterion chosen.

According to the illustrated example, the basis selected is the spherical modes basis because this basis provides the ability to simplify the calculations to be performed while maintaining a good level of precision. Indeed, selecting this basis does not involve making an approximation.

By way of a variant, any other basis set could be considered. In particular, the plane wave basis may be used to decompose the wave considered.

The spherical mode basis is defined based on the following observation: in a medium that is isotropic, homogeneous, and source-less, an electric field E is expressed in a spherical basis set referenced with the coordinates r, θ and ϕ in the form:

$$\vec{E}(r,\theta,\varphi)=\sqrt{\eta}\,\frac{1}{\sqrt{4\pi}}\,\frac{e^{jkr}}{r}\sum_{s=1}^{2}\sum_{n=1}^{\infty}\sum_{m=-n}^{n}Q_{smn}^{(3)}\vec{K}_{smn}(\theta,\varphi)$$

Where:

η is the impedance of free space (propagation medium), j is the complex number, k is the norm of the wave vector associated with the electric field E, $Q_{smn}$, is the coefficient of decomposition of the electric field E over the mode s, m, n of the spherical mode basis set, and $\vec{K}_{1mn}(\theta,\phi)$ and $\vec{K}_{2mn}(\theta,\phi)$ are the different spherical modes.

The general mathematical expression of spherical modes is also known as shown by the following equations 3 and 4:

$$\vec{K}_{1mn}(\theta,\varphi)=\sqrt{\frac{2}{n(n+1)}}\left(-\frac{m}{|m|}\right)^{m}e^{jmp}(-j)^{n+1}\left\{\frac{jm\overline{P}_n^{|m|}(\cos\theta)}{\sin\theta}\vec{e}_\theta-\frac{d\overline{P}_n^{|m|}(\cos\theta)}{d\theta}\vec{e}_\varphi\right\}$$

$$\vec{K}_{2mn}(\theta,\varphi)=\sqrt{\frac{2}{n(n+1)}}\left(-\frac{m}{|m|}\right)^{m}e^{jmp}(-j)^{n}\left\{\frac{d\overline{P}_n^{|m|}(\cos\theta)}{d\theta}\vec{e}_\theta-\frac{jm\overline{P}_n^{|m|}(\cos\theta)}{\sin\theta}\vec{e}_\varphi\right\}$$

Where:

$\vec{e}_\theta$ is the unit vector associated with the co-ordinate θ, $\vec{e}_\phi$ is the unit vector associated with the coordinate ϕ, $$\overline{P}_n^m(\cos\theta)=\sqrt{\frac{2n+1}{2}\,\frac{(n-m)!}{(n+m)!}}\,(\sin\theta)^m\frac{d^m}{d(\cos\theta)^m}\left[\frac{1}{2^n n!}\,\frac{d^n}{d(\cos\theta)^n}(\cos^2\theta-1)^n\right]\text{ and}$$

$$\frac{d\overline{P}_n^{|m|}(\cos\theta)}{d\theta}=\begin{cases}-P_n^1(\cos\theta)\sqrt{\dfrac{2n+1}{2}} & m=0\\ \dfrac{1}{2}\Big((n-|m|+1)(n+|m|)\overline{P}_n^{|m|-1}(\cos\theta)-\overline{P}_n^{|m|+1}(\cos\theta)\Big)\sqrt{\dfrac{2n+1}{n}\,\dfrac{(n-|m|)!}{(n+|m|)!}} & |m|>0\end{cases}$$

From the matrix point of view, the existence of the spherical mode basis reflects that in a medium that is isotropic, homogeneous, and source-less, an electric field E is expressed as:

$$E=K\times Q$$

Where:

the θ and ϕ dependence is not used so as to reduce the notations,

E is a vector describing the electric field radiated in different directions in space and for the various different components of the polarisation that is written, for example as:

$$E = \begin{pmatrix} E_\theta(\theta_1, \phi_1) \\ E_\phi(\theta_1, \phi_1) \\ E_\theta(\theta_2, \phi_2) \\ E_\phi(\theta_2, \phi_2) \\ \cdots \end{pmatrix}$$

K is a matrix describing the radiation pattern of the spherical modes that is written, for example as:

$$K = \begin{bmatrix} K_{11-1} & K_{110} & K_{111} & \cdots \\ K_{12-2} & K_{12-1} & K_{120} & \cdots \\ \cdots & \cdots & \cdots & \cdots \\ K_{21-1} & K_{210} & K_{211} & \cdots \\ K_{22-2} & K_{22-1} & K_{220} & \cdots \\ K_{23-3} & K_{23-2} & K_{23-1} & \cdots \\ \cdots & \cdots & \cdots & \cdots \end{bmatrix}$$

Other organisations of the matrix K may be considered at this stage, the previous organisation being given by way of an example. Furthermore, in practice, by way of indication, it may be remarked that the matrix K is free of zero elements.

"x" denotes the matrix multiplication, and

Q is the matrix grouping together the various decomposition coefficients $Q_{smn}$, of the electric field that is written, for example as follows:

$$Q = \begin{pmatrix} Q_{1-11} \\ Q_{2-11} \\ Q_{101} \\ Q_{201} \\ \cdots \end{pmatrix}$$

The employment of matrix formalism provides the ability to simplify the calculations of the method for determining.

When this matrix formalism is applied to the specific case of obtaining of a greater directivity of the antenna array 10 in a direction by the elevation angle $\theta_0$ and the azimuth angle $\phi_0$, it is possible to show a wave satisfying such a criterion is a wave whose matrix grouping together the various different decomposition coefficients $Q_{smn}$ of the electric field satisfies the following equation:

$$Q=Q_{OPT}=a\cdot K^*(\theta_0,\phi_0)$$

where a is a normalisation constant,

"·" denotes scalar multiplication, and

"*" denotes the mathematical operation of complex conjugation.

This latter relationship thus makes it possible to obtain the desired decomposition coefficients.

The method for determining then includes a step of calculating the values of the impedances Z1, Z2 of each load 20, 22 of the antenna array 10 so as to ensure that the difference between the coefficients of decomposition on the basis of the wave generated by the antenna array 10 and the decomposition coefficients desired is minimised.

The calculation step includes a sub-step of expression of the wave generated by the antenna array 10 using the spherical mode basis.

According to a preferred embodiment, this wave expression sub step is implemented by decomposing the electric field associated with the wave generated by the antenna array 10 into an elementary electric field generated by each antenna that is part 10 of the antenna array.

Thus as explained previously, for the specific case of the antenna array 10 shown in FIG. 3, the electric field E1 connected to the first antenna 14, the electric field E2 generated by the second antenna 16 and the electric field E3 generated by the third antenna 18 are related to the total electric field Etotal produced by the antenna array 10 according to the relationship:

$$E\text{total}=E1+E2+E3$$

This decomposition into elementary electrical fields provides the ability to facilitate the calculations performed through the remainder of the process of implementation of the method. Indeed, this decomposition only takes into account the specific structure of each antenna and not any possible loads to which the antenna could be connected.

The expression sub step then includes the expression of each elementary electric field in the spherical mode basis, which is translated mathematically as:

$$Ei=K\times Qi$$

Where:

the θ and ϕ dependence is not used so as to reduce the notations,

Ei is electric field generated by the i-th antenna, and

Qi is the matrix grouping together the different decomposition coefficients $Q_{smn}$ of the electric field generated by the i-th antenna.

The expression sub step then includes a subsequent step of concatenation of the various different matrices Qi grouping together the different decomposition coefficients $Q_{smn}$ of the electric field generated by the i-th antenna in order to obtain a matrix Qtot corresponding to the expression of the wave generated by the antenna array 10 using the spherical mode basis.

The calculation step includes a sub step of calculating the excitation vector that is used to obtain the desired decomposition coefficients represented by the matrix $Q_{OPT}$. This amounts to solving the following equation:

$$Q\text{tot}\times\Lambda=Q_{OPT}$$

Where:

Λ is the excitation vector of the antenna array 10, and

Qtot is the combination within a single matrix of the various Qi.

Upon completion of the sub step of calculating the excitation vector Λ, there is obtained an excitation vector depending only on the structure of the antenna array 10 and on the criterion selected for the wave Ototal generated by the antenna array 10.

The calculation step then includes a subsequent step of determining the values of the impedances Z1, Z2 of each load 20, 22 of the antenna array 10 on the basis of the calculated excitation vector Λ.

In order to do this, according to one embodiment, the following equation is solved:

$$\Lambda = M \times \Lambda + P \times U$$

where:

M is the matrix describing the couplings as well as the reflections associated with each of the loads of the antenna array 10 that is, in the particular case of FIG. 3, with the first and second loads 20, 22, P is the matrix representing the connections between the antenna array 10 and external signals, and U is a vector describing the weighting of the external signals.

Applied to the antenna array 10 shown in FIG. 3, the resolution of the previous matrix equation makes it possible to derive the following solutions:

$$Z1 = 7.6\Omega + i \times 9.95\Omega \text{ and}$$

$$Z2 = 0.1\ \Omega + i \times 13.54\Omega$$

For such values of impedances of the two loads 20, 22 of the array 10, a good directivity in the direction of elevation angle $\theta_0$, and azimuth angle $\phi_0$ is obtained.

Figure 4:
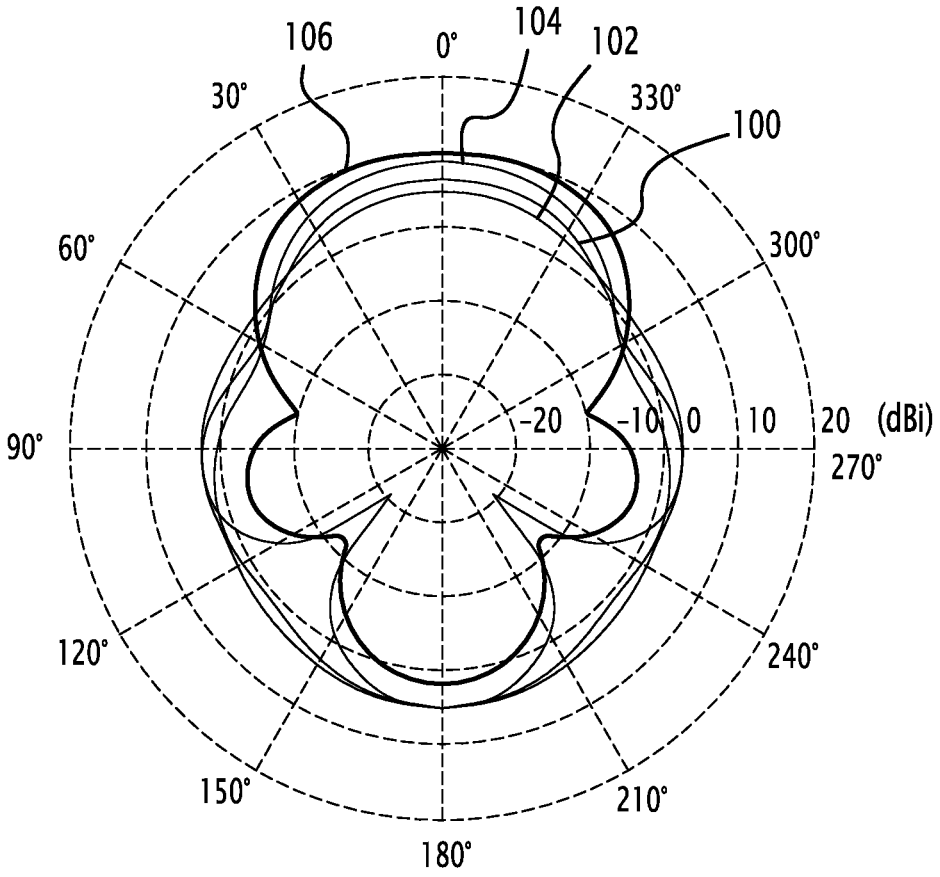
FIG. 4 is a radiation scheme diagram for an antenna array obtained by the method according to the invention.

This is apparent in particular upon studying the FIG. 4. In this FIG. 4, four radiation patterns are represented. Each radiation pattern shows the angular distribution of the radiated power as a function of the azimuth angle $\phi_0$ at a constant elevation angle (in this case $\theta_0$=90°).

The radiation pattern represented by a curve 100 corresponds to the radiation pattern obtained for the array 10 in the presence of a resistive load in place of each of the first and second loads 20, 22; the radiation pattern represented by a curve 102 corresponds to the pattern obtained for the array 10 in the presence of a short circuit in place of each of the first and second loads 20, 22; the radiation pattern represented by a curve 104 corresponds to the pattern obtained for the array 10 in the presence of a reactive load in place of each of the first and second loads 20, 22; and the radiation pattern represented by a curve 106 in bold black line corresponds to the radiation pattern obtained for the array 10 in the presence of the first and second loads 20, 22 having the previously determined values.

It appears that for the direction of elevation angle $\theta_0$=90° and azimuth angle $\phi_0$=0°, the directivity of the array 10 according to the invention is 10 dBi (dBi for decibels isotropic). In a general manner, the directivity of an antenna is normally expressed in dBi, by taking as a reference an isotropic antenna, that is to say a dummy antenna that radiates uniformly in all directions. The directivity of the dummy antenna is equal to 1, that is 0 dBi. The directivity of the array 10 according to the invention is therefore greater than the directivities of the other curves.

The gain in directivity can also be seen by examining the shapes of the curves 100, 102, 104 and 106. In effect, for the antenna array shown in FIG. 3, a reduction of the radiation outside of the principal direction is observed.

Due to this fact, the array 10 shown in FIG. 3 exhibits an improved directivity in the direction of elevation angle $\theta_0$=90° and azimuth angle $\phi_0$=0°.

By way of a variant, instead of considering the directivity as a criterion, other criteria appropriate for the antenna array 10 are considered.

As an example, the criterion corresponds to imposing the requirements that the front to back ratio (also denoted by the English term Front/Back ratio) of the array 10 be greater than a desired value, that the radiation pattern of the array 10 be identical to a radiation pattern obtained with a specific mask or that the radiation pattern of the array 10 in a disturbed environment be identical to a desired radiation pattern.

In each of the proposed cases, a manner of taking into account the criterion is to impose a specific matrix for the matrix grouping together the various different decomposition coefficients $Q_{smn}$ of the electric field in the step of decomposing a wave that satisfies the criterion selected in a basis set so as to obtain the desired decomposition coefficients.

For example, this is the case where the criterion corresponds to imposing that the radiation pattern of the array 10 in a disturbed environment be identical to a desired radiation pattern. By way of an example of application, the antenna array 10 is intended to be fixed on to an upper part of elongated form of a vehicle. The elongated form disturbs the radiation of the antenna array 10. By carrying out the optimisation of the antenna according to the method that is the object of the invention, it is possible to obtain a desired wave form generated by the entire vehicle.

The method for determining previously described above is applicable to any type of antenna array 10 comprising at least one antenna that can be connected to a load. In particular, the antenna array 10 includes, in certain embodiments, a plurality of primary antennas.

By way of a variant, the method for determining also includes modifications to the characteristic features of the structure of the antenna array 10 in a manner so as to facilitate compliance with the selected criterion. For example, it is possible to modify the distance between the first antenna 14 and the second antenna 16. Alternatively, it may be decided to modify the length of the second antenna 16. To do this, it is sufficient to take into account the characteristics of the structure of the antenna array 10 to be varied in the sub step of expressing of the wave generated by the antenna array 10 using the spherical mode basis. The excitation vector will then include the characteristics of the structure of the antenna array 10 to be varied. Solving the equation at the level of the array determining sub step will include not only the determination of the values of the impedances Z1, Z2 of the loads 20, 21 but also the determination of the characteristics of the structure of the antenna array 10 that it is desired to be varied.

In any case, it is obtained an antenna array 10 that presents improved properties. According to the embodiments, the antenna array 10 is fixed, with neither the structure nor the values of the impedances Z1, Z2 of the loads 20, 21 being adjustable. For example, in the case of using the antenna array 10 for pointing the object (for example a remote control) with which the user is communicating, the property of good directivity will be favoured at the expense of others. In other embodiments, depending on the uses, it is necessary to favour one or the other of the properties of the antenna array (passing from a directive configuration into a non-directive configuration). In this case, it is particularly advantageous for the loads 20, 21 to be adjustable. Typically, the loads 20, 21 are potentiometers coupled with a component of variable inductance or variable capacitance. This provides the ability to further increase the adaptable nature of the antenna array 10 according to the invention.

What is claimed is:

1. An antenna array comprising:

at least one primary antenna associated with a source, at least one secondary antenna coupled to at least one load, wherein a load is a passive load or an active load, a load coupled to a secondary antenna, the load comprising two separate components, wherein a first component is a resistor and a second component being selected from the group consisting of an inductor and a capacitor, wherein the load is either an association of a resistor and a capacitor wherein the resistor is distinct from the capacitor, or an association of a resistor and an inductor wherein the resistor is distinct from the inductor.

2. An antenna array according to claim 1, wherein the first component has a negative resistance.

3. An antenna array according to claim 1, wherein the second component has a negative inductance.

4. An antenna array according to claim 1, wherein the second component has a negative capacitance.

5. An antenna array according to claim 1, wherein at least one load has an adjustable impedance.

6. An antenna array according to claim 1, wherein the antenna array is used in a system, wherein the system is selected from the group consisting of a vehicle, a terminal, a mobile phone, a wireless network access point, a base station and a radio frequency excitation probe.

7. An antenna array comprising:

at least one primary antenna associated with a source, at least one secondary antenna, at least one load coupled to a secondary antenna, the load comprising two separate components, wherein a first component is a resistor and a second component being selected from the group consisting of an inductor and a capacitor, and wherein each of the antennas are physically separated, wherein the load is either an association of a resistor and a capacitor wherein the resistor is distinct from the capacitor, or an association of a resistor and an inductor wherein the resistor is distinct from the inductor.

* * * * *